US009260167B2

(12) United States Patent
Goldsmith

(10) Patent No.: US 9,260,167 B2
(45) Date of Patent: Feb. 16, 2016

(54) BUOY-FITTED SELF-ADJUSTING SYSTEM AND METHOD FOR PROTECTION OF BOAT HULLS

(71) Applicant: Manning M. Goldsmith, Savannah, GA (US)

(72) Inventor: Manning M. Goldsmith, Savannah, GA (US)

( * ) Notice: Subject to any disclaimer, the term of this patent is extended or adjusted under 35 U.S.C. 154(b) by 0 days.

(21) Appl. No.: 14/591,494

(22) Filed: Jan. 7, 2015

(65) Prior Publication Data

US 2015/0191229 A1 Jul. 9, 2015

Related U.S. Application Data

(63) Continuation-in-part of application No. 14/468,452, filed on Aug. 26, 2014.

(60) Provisional application No. 61/869,801, filed on Aug. 26, 2013.

(51) Int. Cl.
*B63B 59/00* (2006.01)
*B63B 59/04* (2006.01)

(52) U.S. Cl.
CPC ..... *B63B 59/045* (2013.01)

(58) Field of Classification Search
CPC ..... B63B 59/045
See application file for complete search history.

(56) References Cited

U.S. PATENT DOCUMENTS

| | | | | |
|---|---|---|---|---|
| 3,205,851 | A | 9/1965 | Wiswell, Jr. | |
| 3,685,477 | A | 8/1972 | Wood | |
| 4,282,822 | A * | 8/1981 | Jackson | 114/222 |
| 4,693,200 | A | 9/1987 | Noble | |
| 5,465,676 | A | 11/1995 | Falcaro | |
| 5,549,069 | A | 8/1996 | Faidi | |
| 6,047,658 | A | 4/2000 | Tansy | |
| 6,152,061 | A | 11/2000 | Perez-Collazo | |
| 6,276,292 | B1 | 8/2001 | Soulek | |
| 6,327,991 | B1 | 12/2001 | Eichert | |
| 6,568,343 | B1 | 5/2003 | Hill et al. | |
| 7,047,900 | B2 | 5/2006 | Nelson | |
| 8,739,724 | B2 | 6/2014 | Howard | |
| 2011/0120362 | A1 | 5/2011 | Costas | |

FOREIGN PATENT DOCUMENTS

| | | | |
|---|---|---|---|
| AU | 2003100664 | A4 | 10/2003 |
| AU | 2005222514 | A1 | 4/2007 |
| AU | 2007101216 | A4 | 2/2008 |
| EP | 0360436 | A1 | 3/1990 |
| JP | 2001239989 | A | 9/2001 |
| JP | 2003276684 | A | 10/2003 |
| JP | 2007062419 | A | 3/2007 |

* cited by examiner

*Primary Examiner* — Edwin Swinehart
(74) *Attorney, Agent, or Firm* — Gardner Groff Greenwald & Villaueva, PC

(57) ABSTRACT

A boat hull protective system for retarding grown of barnacles or other aquatic sea life that may be capable of growing on the bottom of a boat hull or other marine equipment that is submerged in water. Additionally, the boat hull protective system provides for stabilizing the boat and cushions the same from trauma from contiguous structures (e.g., docks and the like).

14 Claims, 7 Drawing Sheets

BUOY-FITTED SELF-ADJUSTING SYSTEM AND METHOD FOR PROTECTION OF BOAT HULLS

CROSS-REFERENCE TO RELATED APPLICATIONS

This application is a continuation-in-part of U.S. Non-Provisional patent application Ser. No. 14/468,452 filed Aug. 26, 2014, which claims the benefit of U.S. Provisional Patent Application Ser. No. 61/869,801 filed Aug. 26, 2013, the entireties of which are hereby incorporated herein by reference for all purposes.

TECHNICAL FIELD

The present invention is generally directed to the field of marine equipment, and more particularly to an in-situ system and method for protection of boat hulls and other marine equipment to prevent or reduce bottom growth and/or cushion against damage from floating dock trauma.

BACKGROUND

In warm water climates boat bottoms are plagued by barnacle and other sea life overgrowth. Boats and other marine equipment with hulls and/or other portions that stay continuously submerged in such waters commonly must be pulled out of the water frequently to have their bottoms scraped and repainted. Despite anti-filing paints, which somewhat retard bottom growth, such boats must be frequently pulled out of the water at great cost and/or divers must frequently scrape the bottoms. Alternatively, one may build an expensive boat lift which is fraught with many potential problems as they obstruct views; cables rust and lift equipment has limited lifespan; pilings need replacing; and they are not easy to operate. Jet docks are similarly difficult to navigate boat landings upon, and more recently they have come under regulatory scrutiny for their environmental impact on marsh ecosystems.

Accordingly, it can be seen that needs exist for improved systems and methods for preventing sea life from growing on boat hulls and other submerged marine equipment and objects. It is to the provision of improved systems and methods for retarding grown of barnacles or other sea life on a boat hull or other submerged marine equipment and objects that the present invention is primarily directed.

SUMMARY

In example embodiments, the present invention comprises a system and method utilizing a boat hull blanket or containment cover for retarding grown of barnacles or other sea life that may be capable of growing on the bottom of a boat hull or other marine equipment that is submerged in water.

Rather than lift a boat out of the water to protect it from bottom overgrowth, example embodiments of the invention "net" or surround the bottom of a boat or other marine equipment or objects with a protective cover while in the water. This in situ protective bottom cover prevents circulation of water in the bottom/cover interface and thus there are no nutrients to sustain bottom growth. Simultaneously the boat net provides an outer buoy assembly to stabilize and cushion the boat from floating dock trauma. Additionally, the boat net assembly preferably will not entrap fish, dolphins, or other aquatic life, because of its uniquely spaced and partially submerged non porous sheet structure which permits easy egress of such aquatic life in and out of such assembly. The boat net is optionally buoy-fitted and self-adjusting such that no further adjustment or action is required after the boat is engaged with the boat net.

In one aspect, an example embodiment of the invention relates to a system including a frame or support structure and a non-porous sheet structure attached to the frame. The frame and sheet structure are preferably configured to generally conform to the shape of the boat hull or other marine equipment to be protected. By shielding the protected equipment from the water current and flow of nutrients, and optionally defining a layer of stagnant and/or elevated temperature water around the protected equipment, bottom growth of barnacles and/or other sea life on the protected equipment is reduced or prevented.

Optionally, the frame or support structure includes an adjustable system of pipe segments connected in a desired configuration by a chain or other flexible member threaded through the pipe segments.

In one example form, the system includes at least one flotation buoy coupled to the sheet structure or frame/support structure such that the system is buoy-fitted and self-adjusting when the boat hull is received within the contained space and generally against the sheet.

In another aspect, an example embodiment of the invention relates to a boat bottom covering assembly for protecting a boat hull or other marine equipment from sea life growth and/or protecting the equipment from trauma damage when anchoring the boat against a dock. The boat bottom covering optionally includes at least one pipe segment(s) generally conforming to at least a portion of the contour of a boat or other protected equipment, an impermeable sheet material connected to the at least one or more pipe segments, and at least one flotation buoy.

In one example form, the at least one flotation buoy acts to self-adjust the sheet material to cover the boat hull as it is docked. In example embodiments, the boat bottom covering assembly is buoy-fitted and self-adjusting such that the boat can enter/exit from the covering assembly without manipulating any portion of the assembly.

In still another aspect, an example embodiment of the invention relates to a method of docking and disembarking a boat or other marine equipment and protecting against bottom growth and/or trauma from docking, the method optionally including providing a boat hull blanket having a bow portion and a stern portion for containing a substantial portion of a boat hull; and moving the stern portion of the boat hull blanket relative to the bow portion of the boat hull blanket to engage or disengage the stern portion of the boat hull blanket from the stern of the boat hull.

In another aspect, an example embodiment of the invention relates to a method of preventing flow of nutrients to a boat hull or other equipment, the method including providing a boat hull blanket having a bow portion and a stern portion whereby an impermeable sheet material is connected therebetween for containing a substantial portion of the boat hull; and providing an entrapped and stagnant thin-water interface between the impermeable sheet material and the boat hull.

When taken in conjunction with the accompanying drawings and the appended claims, these and other features and advantages of the present invention become apparent upon reading the following detailed description of example embodiments of the invention.

BRIEF DESCRIPTION OF THE DRAWINGS

Example embodiments of the invention are illustrated in the drawings in which like reference characters designate the same or similar parts throughout the figures of which.

DETAILED DESCRIPTION OF EXAMPLE EMBODIMENTS

Figure 1A:
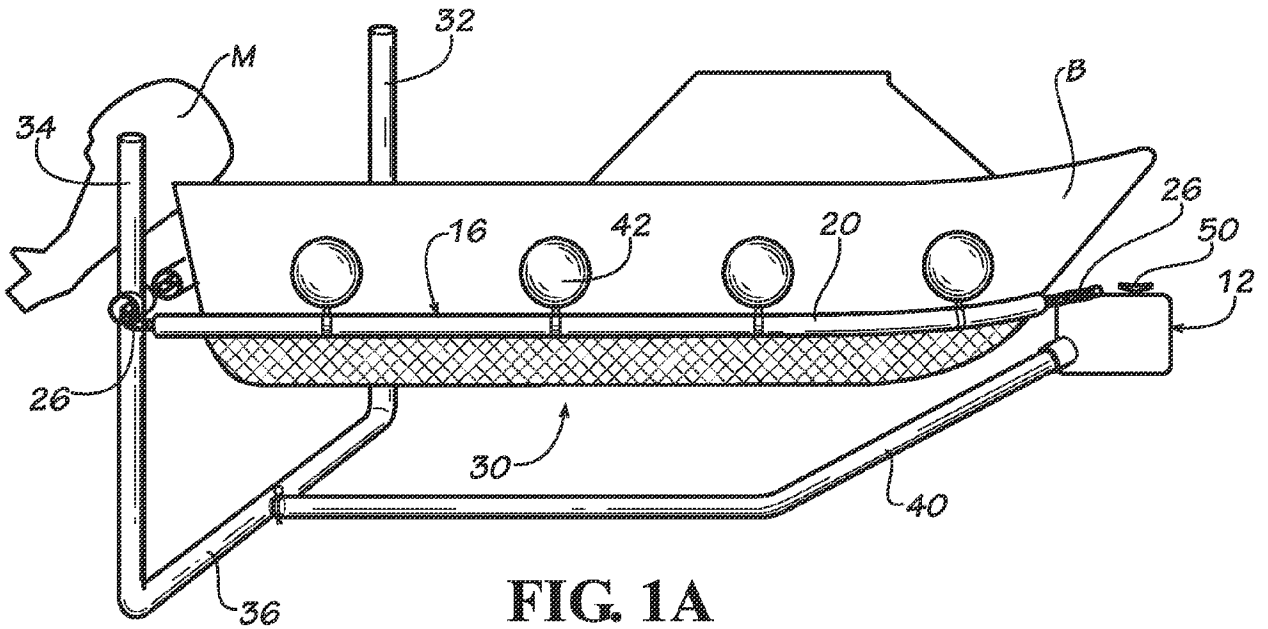
FIG. 1A is a side perspective view of a boat hull blanket according to an example embodiment of the present invention, and showing the boat hull blanket cooperatively engaged with a boat hull of a boat.
Figure 1C:
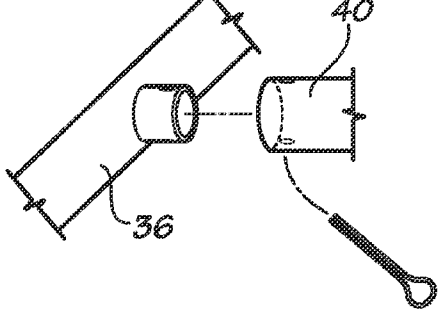
FIGS. 1C-D show side perspective views of the connection between a connecting pole and a stabilizer strut thereof shown in FIG. 1A.
Figure 1D:
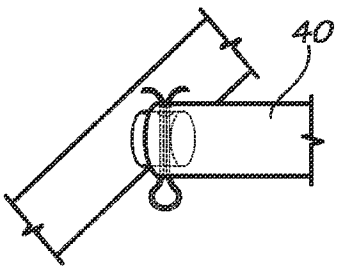
Figure 1B:
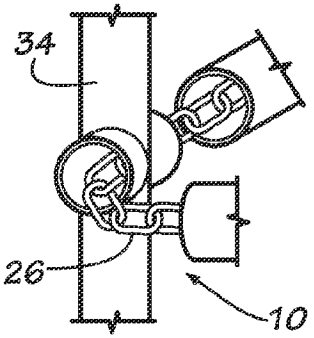
FIG. 1B is a side perspective view of a portion of the boat hull blanket of FIG. 1A.
Figure 2:
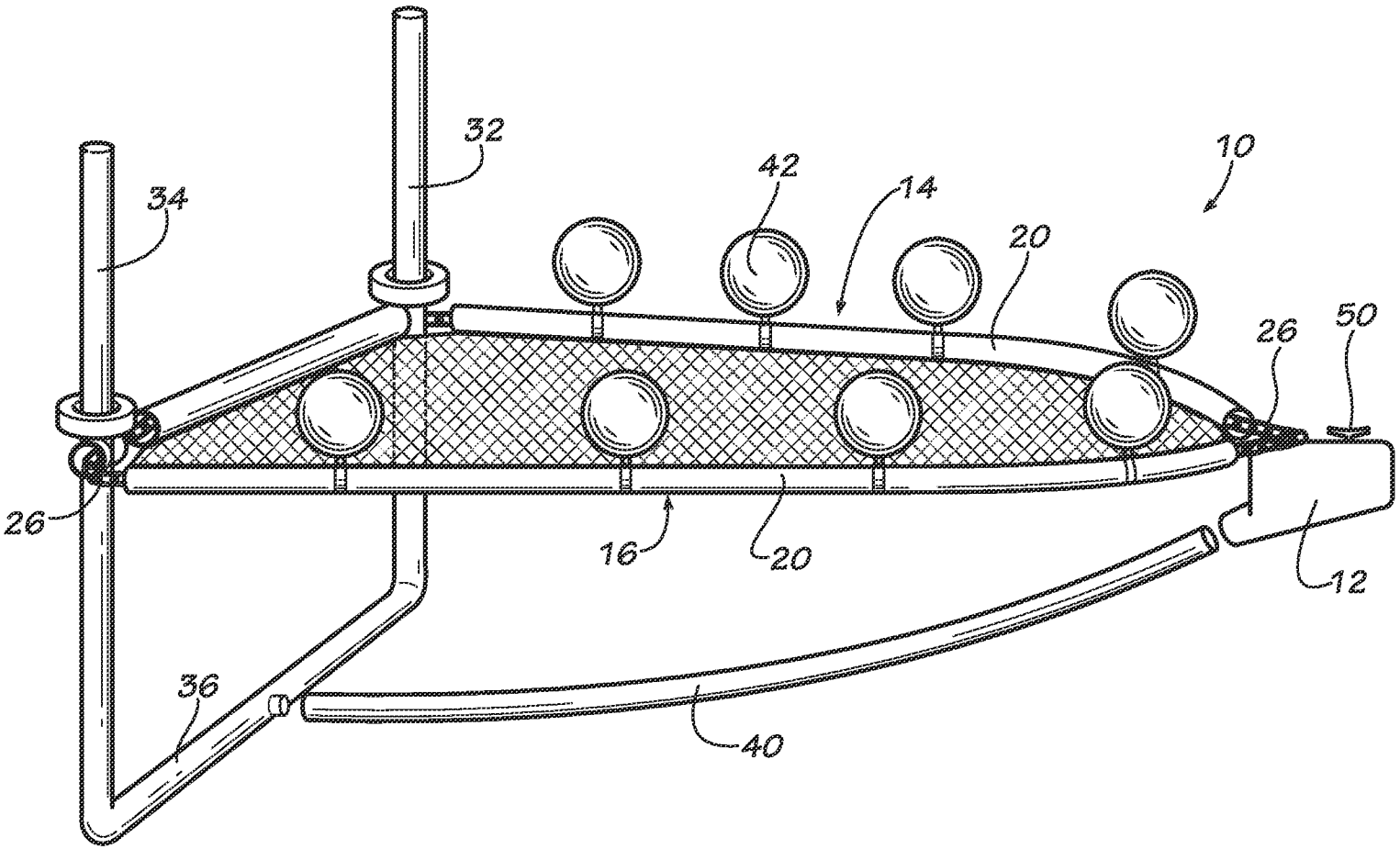
FIG. 2 is a side perspective view of the boat hull blanket of FIG. 1A.
Figure 3:
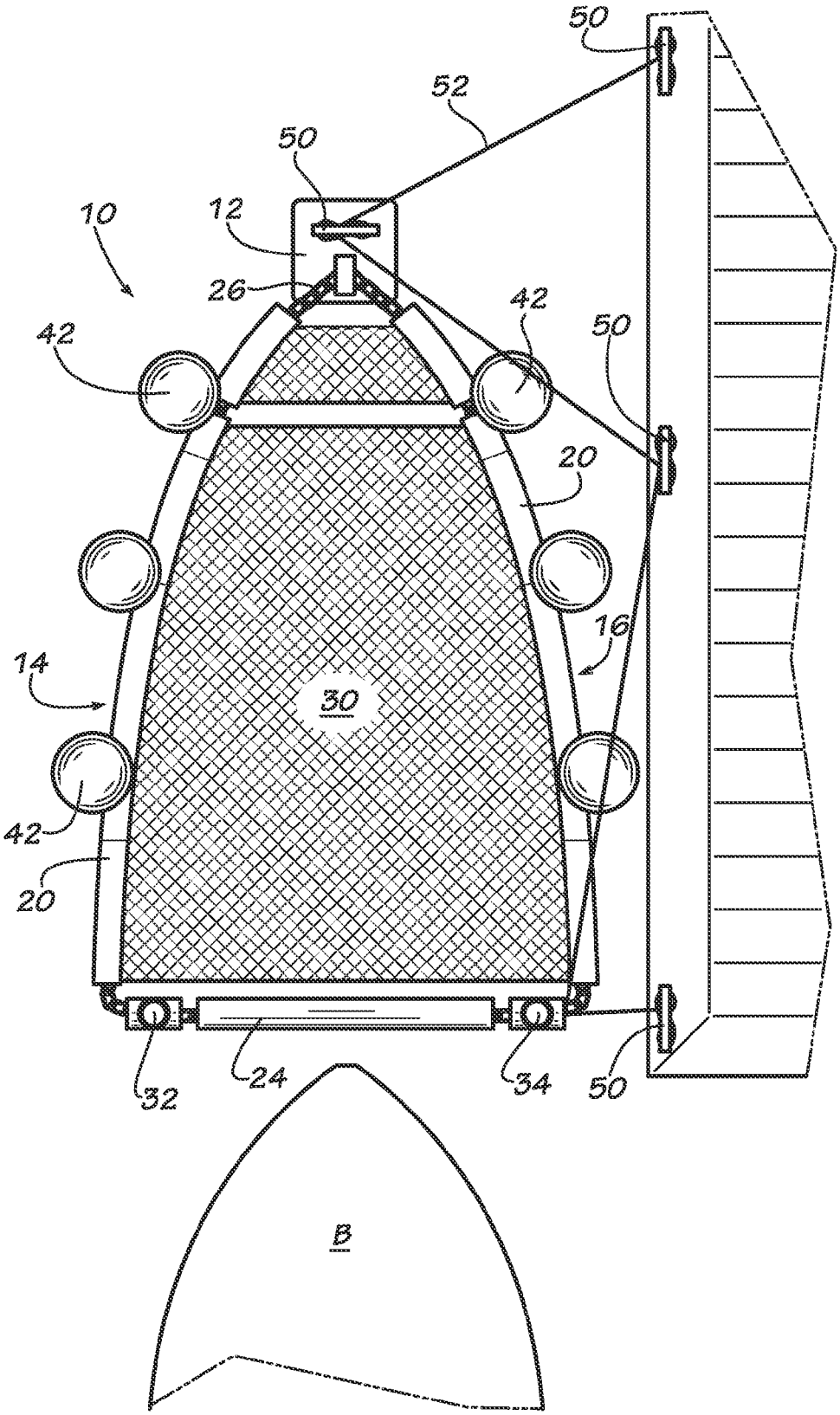
FIG. 3 is a top view of the boat hull blanket of FIG. 1A, showing the boat hull blanket anchored to a boat dock.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-5 show a boat hull blanket or protective system 10 according to an example embodiment of the present invention. Generally, the boat hull protective system 10 is adapted and configured to provide for substantially containing the hull of a boat B that is floating in water (unshown). Preferably, the boat hull protective system 10 is capable of being anchored or connected to a boat dock D or other structure adjacent (or partially submerged) a body of water such that the boat B is anchored to the dock D when the boat B is seated within or against the boat hull protective system 10. As such, barnacles and other sea life growth are prevented by creating a stagnant thin-water interface between the hull of the boat B and a blanket 30 of the boat hull protective system 10.

In example forms, the boat hull protective system 10 comprises an adjustable system of pipe segments 20, 24 to which varying lengths of silicone coated rubber sheets or blankets 30 are attached. These sheets 30 may be made out of silicone coated rubber, PVC, stainless steel mesh, copper mesh, and/or other materials configured to surround the boat bottom generally conforming to the shape of the hull of the boat to be protected without unduly scratching or traumatizing its surface. Preferably, the one or more blankets 30 are impermeable such that water or other aqueous solutions are incapable of flowing therethrough. The blankets are preferably flexible and optionally may have a degree of elasticity to more effectively conform to varying hull and equipment contours. Generally, it is not necessary for the blanket 30 to closely hug the boat bottom, because the mechanism of preventing growth is to shield the bottom from the water current and hence limit the flow of nutrients to the exposed boat bottom. Thus, a thin layer of stagnant water may exist in the interface between the net and the boat bottom. Such a stagnant water interface will become heated, further retarding bottom growth.

In example embodiments, a connecting chain 26, for example constructed of galvanized or stainless steel is used to thread the pipe segments 20, 24 in the configuration shown in the attached figures (see FIGS. 1-5). Optionally, other chain, rope, cable, string, or other elongate and flexible materials may be used. In one form, the rubber pipe segments 20, 24 are reinforced internally with steel mesh to prevent frictional wear from differential movement of the chain 26 within the pipe segments 20, 24. The pipe segments 20, 24 are optionally constructed of rubber, PVC, ABS, vinyl, composite, plastic, polymer and/or other flexible, resilient and/or non-marring material(s), or can be of solid construction and coated or cladded with such materials.

Figure 4B:
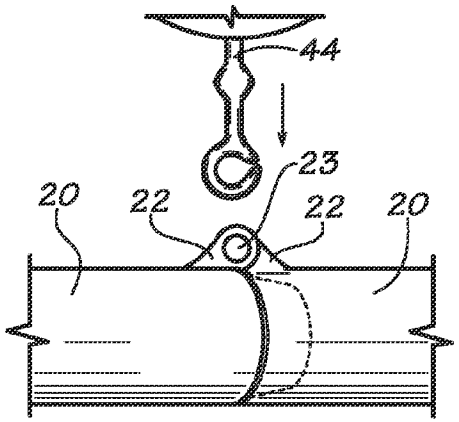
FIG. 4B is a detailed view of a portion of the pipe segments of FIG. 4A, showing the connection between pipe segments and the flotation buoy.
Figure 4A:
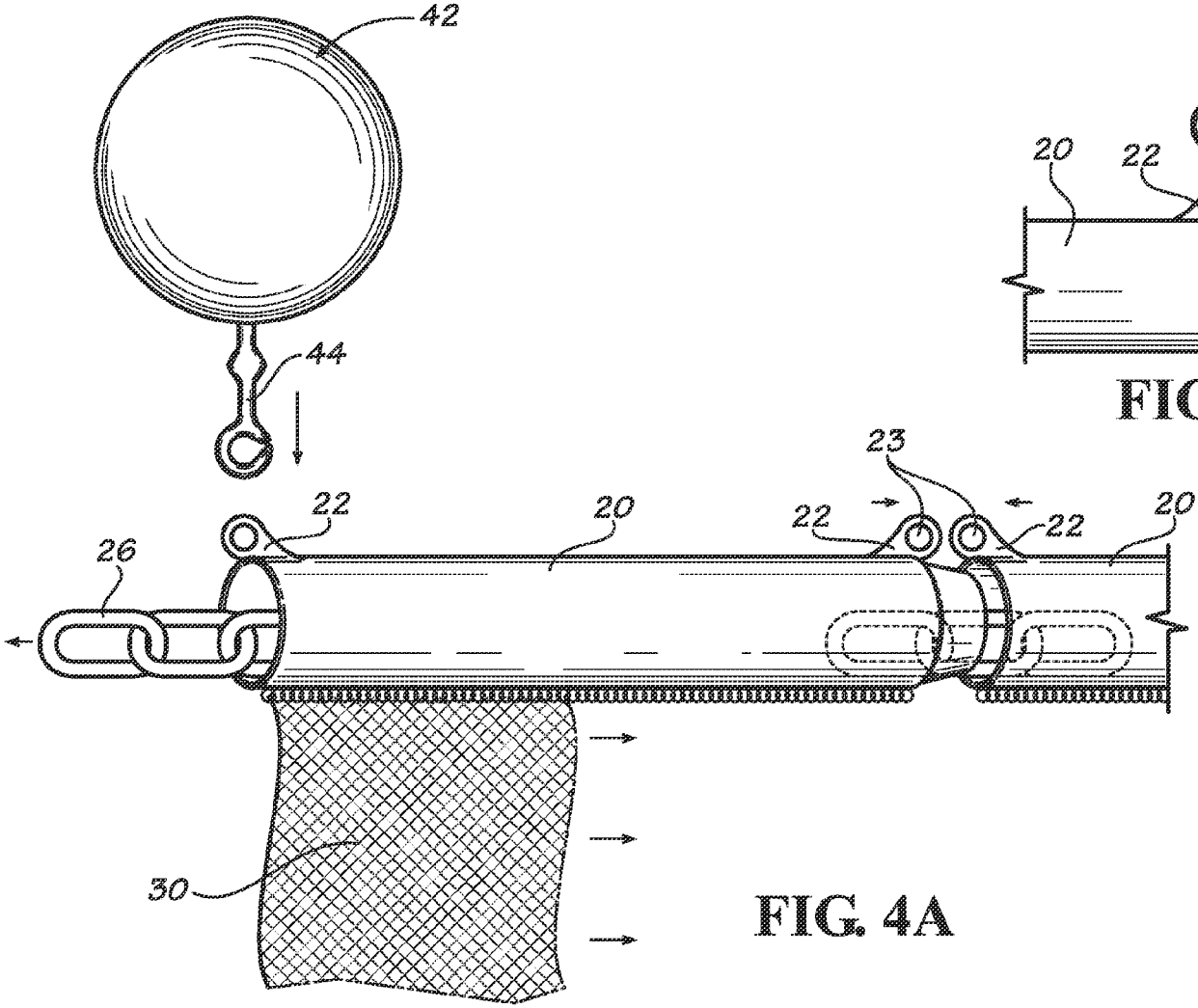
FIG. 4A is a detailed view of the pipe segments shown in FIG. 1A, showing the connection of the pipe segments, the connection of the flotation buoys, and the connection of the blanket with the pipe segments.
Figure 5:
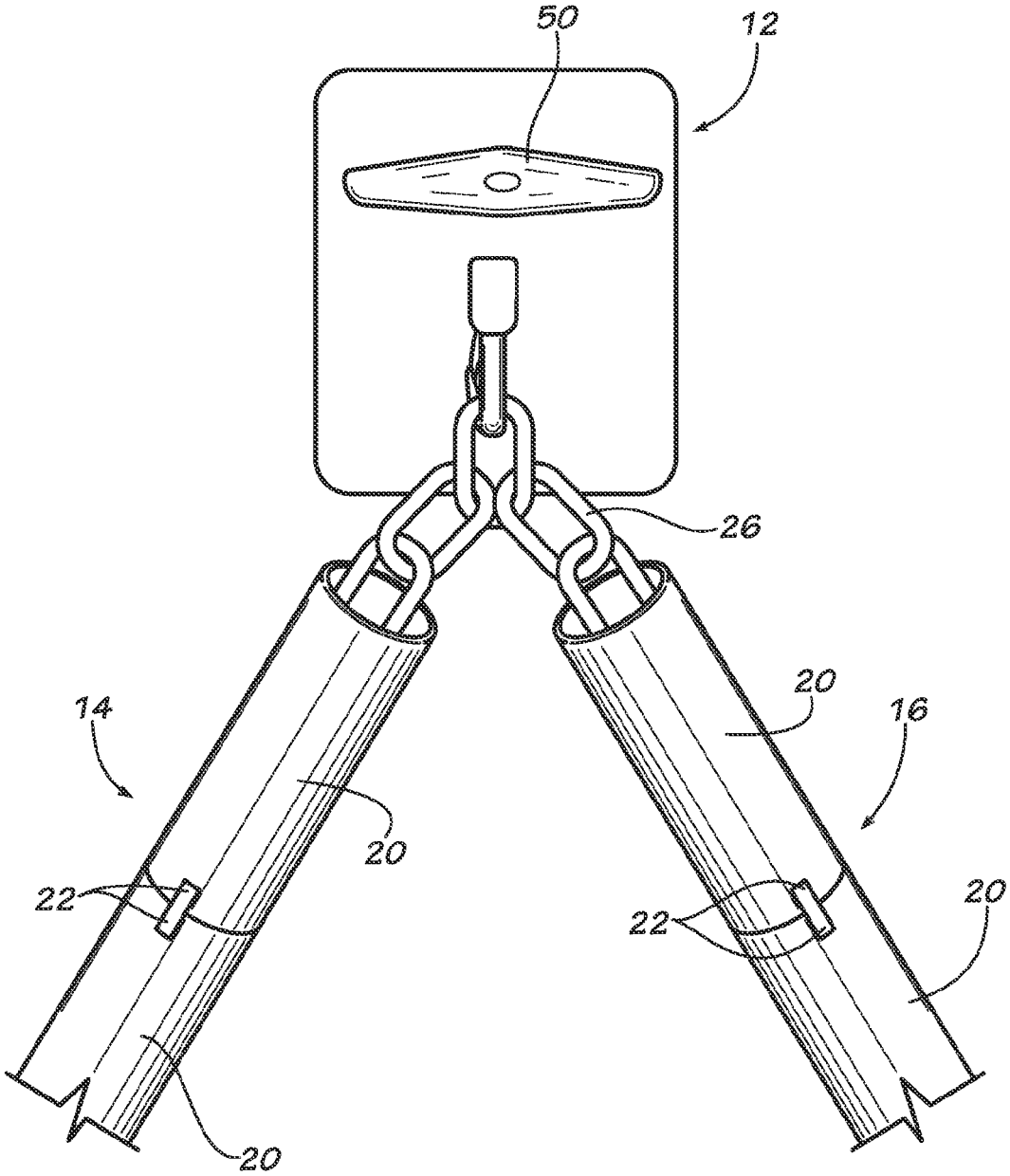
FIG. 5 is a detailed top view of the bow configuration of the boat hull blanket of FIG. 1A.

The one or more silicone coated rubber sheets or blankets 30 attached to the rubber pipe segments provide for the "blanket" function. Preferably, the boat hull protective system 10 is configured to be fitted to the measured displaceable volume and geometric configuration of the submerged boat bottom or hull. Thus, the lengths of the one or more blankets 30 between the connecting pipes 20 (to cover the breadth of the boat B) and the quantity of pipe segments 20 (to fit the length of the boat B) can be adjusted accordingly. The connecting chain 26 is then threaded through the pipe segments, and a round flotation buoy 42 and connector 44 extending therefrom attaches through an eyelet 23 of a connecting arm 22 at each pipe segment juncture as illustrated in FIG. 4. In example form, each of the pipe segments comprises the connecting arms 22, which are configured and adapted to mesh or couple with a connecting arm 22 of another pipe segment 20.

In example embodiments, the chain 26 is threaded through a first side skeleton 14 of pipes 20, through a first spacer pole 32, through a terminal or stern pipe 24, through a second spacer pole 34, and through a second side skeleton 16 of pipes 20. The ends of the chain 26 extending from the first and second side skeletons 14, 16 are then mounted to a bow attachment 12. In one example form, the bow attachment 12 acts as a buoy and maintains buoyancy on the water. Optionally, a connector may be provided such that a buoy 42 can mount thereto such that the bow attachment 12 maintains buoyancy.

In example embodiments, the terminal or stern pipe 24 is positioned opposite the bow attachment 12. Generally, the first and second spacer poles 32, 34 are spaced a distance away from one another (generally at least the width of the boat B) by a submerged weighted connecting pole 36, and a stabilizer strut 40 extends between the bow attachment 12 and the connecting pole 36. This allows the stern pipe 24 to be movable (generally up and down) for docking and disembarking the boat B, for example, to permit lowering or depression of the stern pipe 24 for disembarking by pressing downward on the first and second spacer poles 32, 34.

Thus in an example method of use, when the boat returns for docking (see FIG. 3), the captain preferably aims the boat between the first and second spacer poles 32, 34 and the boat B engages the blanket 30, thus bringing the attached buoys toward the boat as the blanket 30 is progressively pushed down by the hull of the boat B. As long as the buoys are contacting the sides of the boat and/or are at least partially submerged, the blanket 30 will be appropriately snug against the boat bottom when finished docking. The bow attachment 12 prevents "overshooting the mark" as does alignment with the spacer poles 32, 34 with the stern of the boat B. Accordingly, in example embodiments, the system 10 is buoy-fitted and self-adjusting such that when the hull of the boat B is received with the blanket 30, the buoys act to self-adjust and automatically provide for a snug fit of the blanket 30 against the hull of the boat B.

Once the boat B comes to rest and is properly aligned with the spacer poles, the stern portion (e.g., spacer poles 32, 34, connecting pole 36, and stern pipe 24) is pulled upward by upward pull on the spacer poles 32, 34 so that the terminal pipe 24 is contiguous with the stern bottom, yet anterior to the outboard motor or prop M. Confirmation that the boat is appropriately contained is provided if the pipes 20 of the first and second side skeletons 14, 16 and stern pipe 24 are snug against the sides and stern of the boat, and the buoys 42 are snug against the boat B and at least partially submerged. This ensures a stagnant thin water interface between the boat net and bottom, thus preventing bottom growth. In example embodiments, the system 10 is buoy-fitted and self-adjusting such that the boat B can enter/exit from the blanket 30 without the necessity of the operator separately manipulating any other portion of the system 10.

Preferably, the boat hull protective system 10 can be configured to be anchored to the dock D (or floating dock) by running anchor line 52 through one or more cleats or other connectors 50 affixed to the dock D and through portions of the boat hull protective system 10. And, the boat will generally be independently cleated or anchored to the dock D by one or more segments of anchor line 52 (unshown). Preferably, the boat hull protective system 10 provides for stabilizing the boat B and cushions the same from trauma from contiguous structures (e.g., docks D and the like). Optionally, the boat hull protective system 10 is anchored to the dock D and the boat B is anchored to the boat hull protective system 10 (rather than being independently anchored to the dock D).

Figure 6:
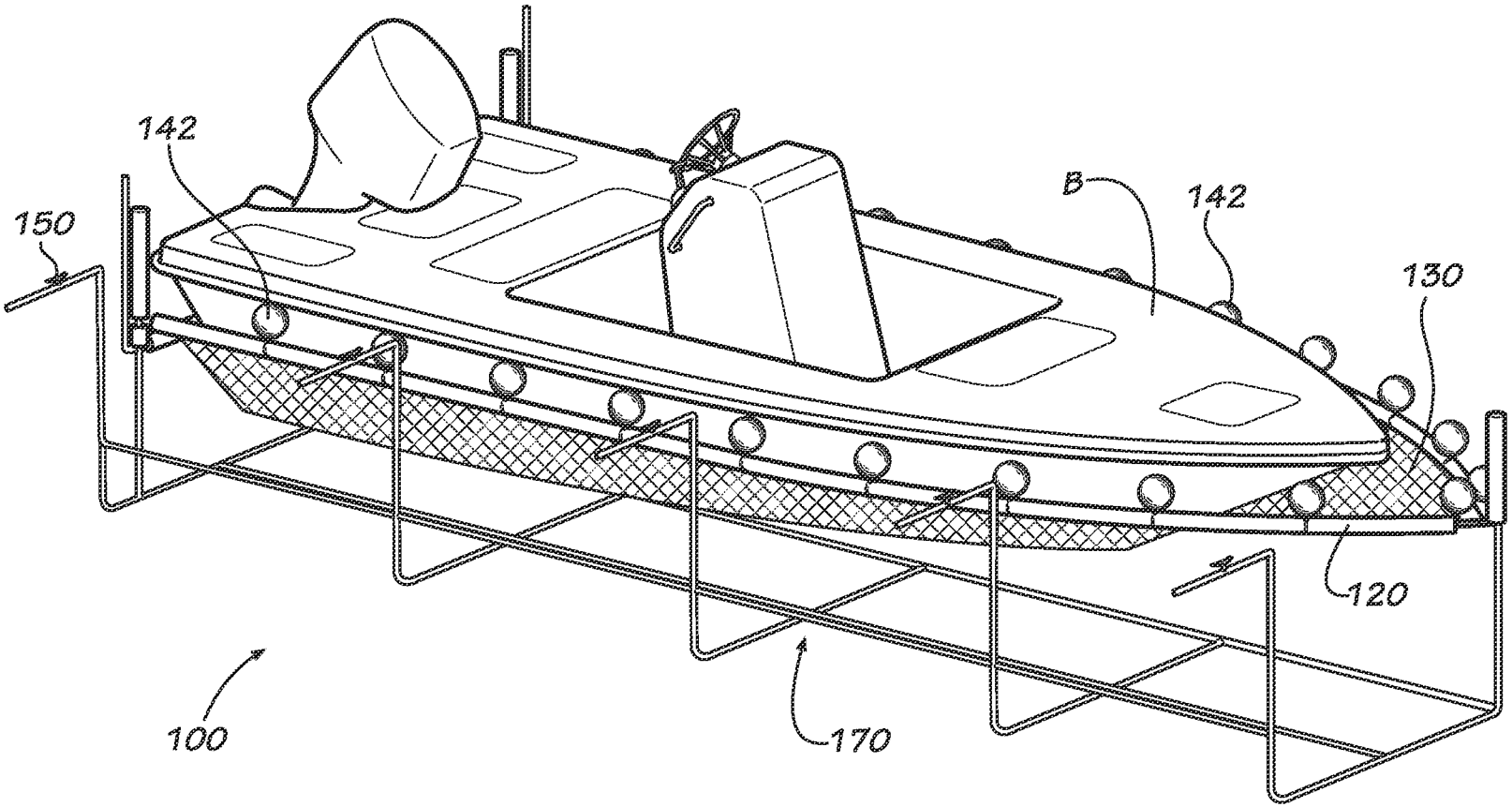
FIG. 6 is a side perspective view of a boat hull blanket according to another example embodiment of the present invention, and showing the boat hull blanket cooperatively engaged with a boat hull of a boat.
Figure 7:
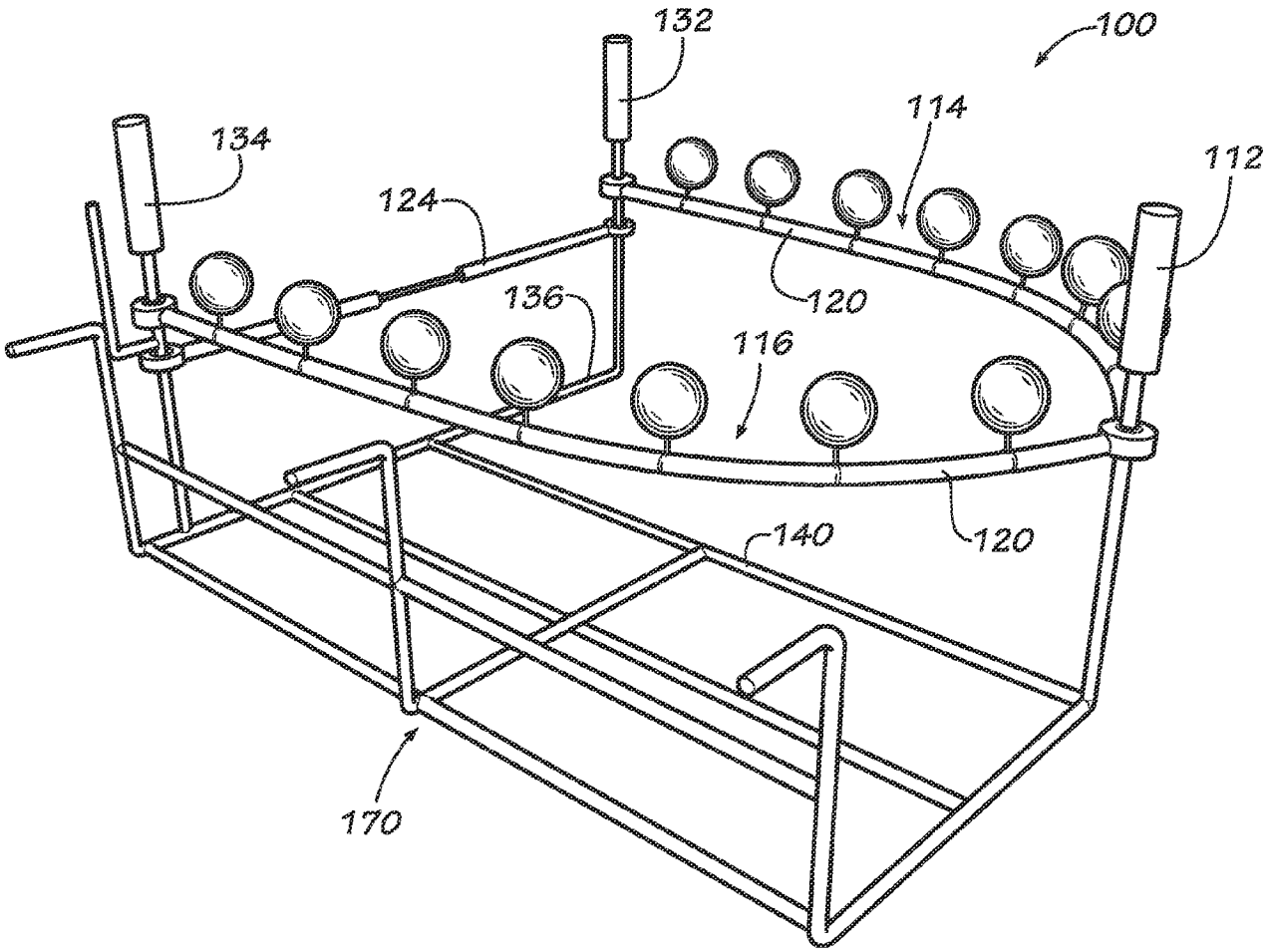
FIG. 7 is a side perspective view of the boat hull blanket of FIG. 6.

FIGS. 6 and 7 show a boat hull blanket or protective system 100 according to another example embodiment of the present invention. As depicted, the boat hull protective system 100 is generally similar to the boat hull protective system 10 as described above, for example comprising an adjustable system of pipe segments 120, 124 to which varying lengths of silicone coated rubber sheets or blankets 130 are attached. As shown in FIG. 6, the boat hull protective system 100 is protecting the boat B such that the blanket 130 creates a stagnant thin-water interface between the hull of the boat B and the blanket 130. In example embodiments, a frame assembly or structure 170 is configured to be fitted with the pipe segments 120, 124. As shown in FIG. 7, the first and second side skeletons 114, 116 extend from the bow attachment or upright post 112 to respective spacer poles or upright posts 132, 134 near the stern portion of the boat hull protective system 100. Preferably, the pipe segments 120, 124 that are engaged with the upright posts 112, 132, 134 generally comprise a sleeve, collar or ring-like mounting portion that slidingly engages the upright posts 112, 132, 134. In example forms, the pipe segments 120, 124 are coupled together by extending a cable therethrough. Optionally, the ends of each segment 120, 124 may comprise one or more coupling or interengagement features for providing interengagement therebetween. Preferably, one or more buoys 142 are removably coupled to the first and second side skeletons 114, 116.

The frame assembly or structure 170 generally comprises a plurality of framing members or rigid pipes that form a structure for supporting the elements of the boat hull protective system 100 and for coupling the boat hull blanket to the dock D or other structure proximal a body of water. As similarly described above, the structure comprises a connecting pole 136 (e.g., generally extending between the two upright posts 132, 134) and a stabilizer strut 140 (e.g., extending between the connecting pole 136 and the bow attachment 112). Preferably, one or more L-shaped members extend from a portion of the structure 170 for coupling to the dock D or other structure, for example, with screws, other fasteners, mounting brackets, etc. Optionally, one or more cleats 150 may be provided on each of the L-shaped members for securing the boat B to the boat hull protective system 100.

Example embodiments of the present invention are configured so that the buoys 42, 142 of the boat hull blanket 10, 100 act to self-adjust the blanket to automatically cover the hull of the boat as it is docked. Thus, after the boat is docked, no other steps are required to adjust the blanket to ensure that it is fitting appropriately against the boat hull. The buoyancy of the buoys lifts the frame and blanket to self-adjust to fit the system to the hull, and the frame segments 20, 120 articulate relative to one another such that the frame flexes and self-adjusts around the hull. Optionally, the stern portion (e.g., spacer poles 32, 34, connecting pole 36, and stern pipe 24) or pipe segment 124 may be linked to a handle 180 or other linkage to provide for manually raising or lowering the stern portion or pipe segment such that the boat hull can be releasably locked to maintain engagement with the blanket or to be unlocked so that the boat can be removed from the system. According to one embodiment of the present invention, the blanket is generally sized to cover at least a portion of the boat hull that is sitting (floating on the water) at the water level and below, and wherein the buoys being tied to portions of the side skeletons act as a spring, resisting yet smoothly displacing due to the presence of the boat hull and pulling the blanket closely around the hull. Typically, the buoys remain floating at least partially at or near the water surface when the boat hull is engaged with the blanket. Thus, even though the force of the boat hull is greater than the buoyancy force of the buoys, the buoys' position relative to the blanket ensures that the buoys will remain afloat and position the blanket to surround the hull at or about the water line. Optionally, the buoys are generally fitted near the blanket and the blanket is appropriately sized to fit the hull, thus the buoys still remain at least partially above water when the boat hull is positioned therein. In one form, the buoy connector 44 is adjustable to ensure the buoys remain floating, for example wherein the boat hull may be slightly too large for the blanket being used. Optionally, the buoy connector or other adjustable clips, cables, cords, linkages, interengagement features, etc. may be provided to link the buoys at a desired distance away from the side skeletons and/or the blanket. In some example forms, the adjustability of the blanket allows for the blanket to fit a wider range of boat hulls of different sizes.

In additional example embodiments, the boat protection systems 10, 100 of the present invention provide a protective cushion or cushioned anchor-like system for both cushioning and retaining the boat within the systems 10, 100, for example when it is desired to dock or anchor the boat near a dock or other structure comprising at least one of the systems 10, 100. Preferably, the systems 10, 100 provide a protective cushion for both the docking side of the boat as well as the non-docking side of the boat. Thus, rather than requiring immediate attention to protective equipment when docking the boat (e.g., deploying one or more buoys, the anchor lines/rope, etc.), the boat is received and automatically self-adjusted by the systems 10, 100 to position and protect the boat hull such that no additional cushioning and/or anchoring is required. Optionally, one or more anchor lines or ropes may be provided for securely anchoring the boat to the protective system 10, 100.

In additional example embodiments, the present invention further provides a method of docking and/or disembarking a boat B. The method comprises providing a boat hull blanket having a bow portion and a stern portion for containing a substantial portion of a boat hull; and moving the stern portion of the boat hull blanket relative to the bow portion of the boat hull blanket to engage or disengage the stern portion of the boat hull blanket from the stern of the boat hull.

In yet another example embodiment, the present invention relates to a method of preventing flow of nutrients to a boat hull. The method comprises providing a boat hull blanket having a bow portion and a stern portion whereby an impermeable sheet material is connected therebetween for containing a substantial portion of the boat hull; and providing an entrapped and stagnant thin-water interface between the impermeable sheet material and the boat hull.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims, means-plus-function clause is intended to cover the structures described herein as performing the recited function and not only structural equivalents but also equivalent structures.

While the invention has been described with reference to preferred and example embodiments, it will be understood by those skilled in the art that a variety of modifications, additions and deletions are within the scope of the invention, as defined by the following claims.

What is claimed is:

1. A system for protecting marine equipment in a body of water, the system comprising a flexible sheet of material for surrounding at least a portion of the equipment submerged in the body of water, and a plurality of buoyant floats coupled about the flexible sheet of material, whereby the marine equipment can enter and exit from the system, and whereby the buoyancy of the floats self-adjusts the flexible sheet of material to fit the marine equipment upon entry of the marine equipment into the system;

wherein the system further comprises a frame, wherein the flexible sheet of material is attached within the frame, and wherein the plurality of buoyant floats are coupled to the frame wherein the frame comprises a plurality of segments flexibly coupled to one another, wherein the frame self-adjusts to fit the marine equipment upon entry of the marine equipment into the system;

wherein the plurality of segments of the frame comprise lengths of pipe having a flexible connector extending therethrough, to permit articulation between adjacent segments of the frame; and wherein the flexible connector comprises a chain.

2. The system of claim 1, wherein the plurality of segments of the frame comprise connecting eyelets at ends thereof, and wherein the buoyant floats are coupled to the connecting eyelets.

3. The system of claim 1, wherein the flexible sheet of material defines a space configured contain a limited volume of water around the submerged marine equipment and inhibit aquatic growth on the submerged marine equipment within the contained space.

4. The system of claim 3, wherein the flexible sheet of material is substantially impermeable to a flow of nutrients into the limited volume, thereby inhibiting growth on the submerged marine equipment.

5. The system of claim 1, wherein the flexible sheet of material is selected from silicone, rubber, PVC, stainless steel mesh, or copper mesh.

6. The system of claim 1, wherein the system provides a protective cushion for the marine equipment that is to be retained therein, the protective cushion being provided at least on a docking side and a non-docking side of the marine equipment, and whereby the marine equipment is received and self-adjusted by the system such that no additional cushioning and/or anchoring is required.

7. A system for protecting marine equipment in a body of water, the system comprising a flexible sheet of material for surrounding at least a portion of the equipment submerged in the body of water, and a plurality of buoyant floats coupled about the flexible sheet of material, whereby the marine equipment can enter and exit from the system, and whereby the buoyancy of the floats self-adjusts the flexible sheet of material to fit the marine equipment upon entry of the marine equipment into the system;

wherein the system further comprises a frame, wherein the flexible sheet of material is attached within the frame, and wherein the plurality of buoyant floats are coupled to the frame wherein the frame comprises a plurality of segments flexibly coupled to one another, wherein the frame self-adjusts to fit the marine equipment upon entry of the marine equipment into the system; and wherein the frame comprises at least one pole to which the plurality of segments are slidably coupled to raise and lower the frame upon engagement of the marine equipment.

8. A boat bottom covering assembly for protecting a boat hull from aquatic growth, the covering assembly comprising:

a frame comprising a plurality of pipe segments, the frame defining a contained space for receiving at least a portion of a boat hull submerged within a body of water;

a flexible and substantially fluid impermeable sheet of material connected within the frame to surround the contained space;

a plurality of flotation buoys coupled about the frame, wherein buoyancy of the flotation buoys self-adjusts the flexible and substantially fluid impermeable sheet of material to fit the boat hull as the boat hull is received within the assembly;

wherein the plurality of pipe segments have a flexible connector extending therethrough, to permit articulation of the pipe segments of the frame relative to one another; and wherein the flexible connector comprises a chain.

9. The boat bottom covering assembly of claim 8, wherein the frame assembly is configured for mounting to a dock.

10. The boat bottom covering assembly of claim 8, wherein the plurality of pipe segments of the frame comprise connecting eyelets at ends thereof, and wherein the flotation buoys are coupled to the connecting eyelets.

11. The boat bottom covering assembly of claim 8, wherein the sheet of material is at least partially formed from at least one of silicone, rubber, PVC, stainless steel mesh, or copper mesh.

12. The boat bottom covering assembly of claim 8, wherein a stagnant thin-water interface is formed within the sheet of material in the contained space when the boat hull is positioned therein.

13. The boat bottom covering assembly of claim 8, further comprising at least one cleat mounted to the frame for securing the boat hull to the frame assembly.

14. A boat bottom covering assembly for protecting a boat hull from aquatic growth, the covering assembly comprising:

a frame comprising a plurality of pipe segments, the frame defining a contained space for receiving at least a portion of a boat hull submerged within a body of water;

a flexible and substantially fluid impermeable sheet of material connected within the frame to surround the contained space;

a plurality of flotation buoys coupled about the frame, wherein buoyancy of the flotation buoys self-adjusts the flexible and substantially fluid impermeable sheet of material to fit the boat hull as the boat hull is received within the assembly; and at least one pole to which the plurality of pipe segments are slidably coupled to raise and lower the frame upon engagement of the boat hull.

* * * * *